US008171989B2

(12) United States Patent
Goode et al.

(10) Patent No.: US 8,171,989 B2
(45) Date of Patent: May 8, 2012

(54) WELL HAVING A SELF-CONTAINED INTER VENTION SYSTEM

(75) Inventors: Peter A. Goode, Houston, TX (US); Andrew Gould, Paris (FR); Alan Christie, Sugar Land, TX (US); Charles E. Vise, Jr., St. Bernard, LA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 2569 days.

(21) Appl. No.: 09/920,895

(22) Filed: Aug. 2, 2001

(65) Prior Publication Data

US 2002/0066556 A1 Jun. 6, 2002

Related U.S. Application Data

(60) Provisional application No. 60/225,439, filed on Aug. 14, 2000, provisional application No. 60/225,440, filed on Aug. 14, 2000, provisional application No. 60/225,230, filed on Aug. 14, 2000.

(51) Int. Cl.
*E21B 47/00* (2012.01)
*E21B 47/09* (2012.01)

(52) U.S. Cl. ..... 166/250.01; 166/255.1; 166/254.2

(58) Field of Classification Search ..... 166/335, 166/336, 338, 339, 33, 70, 66.4, 255.1, 250.11, 166/255.2, 193, 194
See application file for complete search history.

(56) References Cited

U.S. PATENT DOCUMENTS

| | | | | | |
|---|---|---|---|---|---|
| 2,713,909 | A | * | 7/1955 | Baker | 166/70 |
| 3,208,529 | A | * | 9/1965 | Corley, Jr. | 166/292 |
| 3,260,112 | A | | 7/1966 | Godbey et al. | |
| 3,268,004 | A | * | 8/1966 | Kiel | 166/106 |
| 3,358,765 | A | * | 12/1967 | Le Blanc | 166/301 |
| 3,412,798 | A | * | 11/1968 | Gregston | 417/56 |
| 3,545,474 | A | * | 12/1970 | Brown | 137/876 |
| 3,877,520 | A | | 4/1975 | Putnam | |
| 3,901,318 | A | * | 8/1975 | Fortenberry | 166/278 |
| 3,937,278 | A | | 2/1976 | Sheshtawy | |
| 4,006,777 | A | | 2/1977 | LaBauve | |
| 4,058,163 | A | * | 11/1977 | Yandell | 166/177.6 |
| 4,194,566 | A | * | 3/1980 | Maly | 166/307 |
| 4,491,177 | A | * | 1/1985 | Baugh | 166/75.15 |
| 4,499,951 | A | * | 2/1985 | Vann | 166/297 |
| 4,618,285 | A | | 10/1986 | Ahlstone | 405/191 |
| 4,646,839 | A | * | 3/1987 | Rickey | 166/335 |
| 4,694,855 | A | * | 9/1987 | Cunningham | 137/519.5 |
| 4,709,719 | A | * | 12/1987 | Littleton et al. | 137/268 |
| 4,785,880 | A | * | 11/1988 | Ashton | 166/53 |
| 4,823,882 | A | * | 4/1989 | Stokley et al. | 166/387 |
| 4,898,235 | A | * | 2/1990 | Enright | 166/64 |

(Continued)

FOREIGN PATENT DOCUMENTS

| | | |
|---|---|---|
| EP | 1181435 | 12/2000 |

(Continued)

*Primary Examiner* — Thomas Beach
*Assistant Examiner* — James Sayre
(74) *Attorney, Agent, or Firm* — Chadwick A. Sullivan

(57) ABSTRACT

A system includes a subsea well and a carousel of tools. The carousel of tools is adapted to automatically and selectively deploy the tools in the well to perform an intervention in the well. The flow of fluid in a well is halted, and a tool is deployed from within the well while the fluid is halted. The tool is allowed to free fall while the fluid is halted. The flow is resumed to retrieve the tool.

16 Claims, 10 Drawing Sheets

U.S. PATENT DOCUMENTS

| | | | | |
|---|---|---|---|---|
| 5,103,177 | A * | 4/1992 | Russell et al. | 324/346 |
| 5,127,472 | A * | 7/1992 | Watson et al. | 166/177.3 |
| 5,188,178 | A * | 2/1993 | Noyes | 166/310 |
| 5,253,709 | A * | 10/1993 | Kendrick et al. | 166/284 |
| 5,787,979 | A * | 8/1998 | Giroux et al. | 166/177.4 |
| 5,955,666 | A | 9/1999 | Mullins | |
| 6,039,122 | A * | 3/2000 | Gonzalez | 166/379 |
| 6,044,905 | A * | 4/2000 | Harrison, III | 166/75.15 |
| 6,056,053 | A * | 5/2000 | Giroux et al. | 166/155 |
| 6,059,032 | A * | 5/2000 | Jones | 166/278 |
| 6,170,573 | B1 | 1/2001 | Brunet et al. | |
| 6,182,765 | B1 * | 2/2001 | Kilgore | 166/381 |
| 6,209,391 | B1 | 4/2001 | Dallas | |
| 6,241,028 | B1 * | 6/2001 | Bijleveld et al. | 175/40 |
| 6,269,875 | B1 * | 8/2001 | Harrison et al. | 166/53 |
| 6,273,189 | B1 * | 8/2001 | Gissler et al. | 166/241.1 |
| 6,302,199 | B1 * | 10/2001 | Hawkins et al. | 166/70 |
| 6,336,238 | B1 * | 1/2002 | Tarlton | 15/3.5 |
| 6,394,181 | B2 * | 5/2002 | Schnatzmeyer et al. | 166/250.15 |
| 6,405,798 | B1 * | 6/2002 | Barrett et al. | 166/250.01 |
| 6,443,228 | B1 * | 9/2002 | Aronstam et al. | 166/250.11 |
| 6,446,718 | B1 * | 9/2002 | Barrett et al. | 166/250.01 |
| 6,454,011 | B1 * | 9/2002 | Schempf et al. | 166/381 |
| 6,454,492 | B1 * | 9/2002 | Dean et al. | 405/158 |
| 6,467,546 | B2 * | 10/2002 | Allamon et al. | 166/381 |
| 6,478,089 | B2 * | 11/2002 | Alves et al. | 166/310 |
| 6,488,093 | B2 * | 12/2002 | Moss | 166/339 |
| 6,533,032 | B1 * | 3/2003 | Seixas et al. | 166/70 |
| 2001/0045282 | A1 * | 11/2001 | Robinson | 166/298 |

FOREIGN PATENT DOCUMENTS

| | | | |
|---|---|---|---|
| EP | 1174585 | | 1/2002 |
| GB | 2299108 | A | 9/1996 |
| GB | 2305196 | A | 4/1997 |
| GB | 2326433 | A | 12/1998 |
| GB | 2330606 | | 4/1999 |
| GB | 2351308 | A1 | 12/2000 |
| GB | 2352042 | | 1/2001 |
| WO | 99/63196 | | 12/1999 |
| WO | WO 99/66172 | | 12/1999 |
| WO | 00/03112 | A1 | 1/2000 |
| WO | WO 00/73625 | | 12/2000 |
| WO | WO 01/48352 | | 7/2001 |

* cited by examiner

WELL HAVING A SELF-CONTAINED INTER VENTION SYSTEM

CROSS-REFERENCE OF RELATED CASES

This application claims the benefit under 35 U.S.C. §119 to U.S. Provisional Patent Application Ser. No. 60/225,439, entitled WELL HAVING A SELF-CONTAINED INTERVENTION SYSTEM, U.S. Provisional Patent Application Ser. No. 60/225,440, entitled "SUBSEA INTERVENTION SYSTEM" and U.S. Provisional Application Ser. No. 60/225,230, entitled "SUBSEA INTERVENTION," all of which were filed on Aug. 14, 2000.

BACKGROUND

The invention generally relates to a well having a self-contained intervention system.

Subsea wells are typically completed in generally the same manner as conventional land wells. Therefore, subsea wells are subject to the same service requirements as land wells. Further, services performed by intervention can often increase the production from the well. However, intervention into a subsea well to perform the required service is extremely costly. Typically, to complete such an intervention, the operator must deploy a rig, such as a semi-submersible rig, using tensioned risers. Thus, to avoid the costs of such intervention, some form of "light" intervention (one in which a rig is not required) is desirable.

Often, an operator will observe a drop in production or some other problem, but will not know the cause. To determine the cause, the operator must perform an intervention. In some cases the problem may be remedied while in others it may not. Also, the degree of the problem may only be determinable by intervention. Therefore, one level of light intervention is to ascertain the cause of the problem to determine whether an intervention is warranted and economical.

A higher level of light intervention is to perform some intervention service without the use of a rig. Shutting in a zone and pumping a well treatment into a well are two examples of many possible intervention services that may be performed via light intervention.

Although some developments in the field, such as intelligent completions, may facilitate the determination of whether to perform a rig intervention, they do not offer a complete range of desired light intervention solutions. In addition, not all wells are equipped with the technology. Similarly, previous efforts to provide light intervention do not offer the economical range of services sought.

A conventional subsea intervention may involve use a surface vessel to supply equipment for the intervention and serve as a platform for the intervention. The vessel typically has a global positioning satellite system (GPS) and side thrusters that allow the vessel to precisely position itself over the subsea well to be serviced. While the vessel holds its position, a remotely operated vehicle (ROV) may then be lowered from the vessel to find a wellhead of the subsea well and initiate the intervention. The ROV typically is used in depths where divers cannot be used. The ROV has a tethered cable connection to the vessel, a connection that communicates power to the ROV; communicates video signals from the ROV to the vessel; and communicates signals from the vessel to the ROV to control the ROV.

A typical ROV intervention may include using the ROV to find and attach guide wires to the wellhead. These guidewires extend to the surface vessel so that the surface vessel may then deploy a downhole tool or equipment for the well. In this manner, the deployed tool or equipment follows the guide wires from the vessel down to the subsea wellhead. The ROV typically provides images of the intervention and assists in attaching equipment to the wellhead so that tools may be lowered downhole into the well.

The surface vessel for performing the above-described intervention may be quite expensive due to the positioning capability of the vessel and the weight and size of the equipment that must be carried on the vessel. Thus, there is a continuing need for an arrangement that addresses one or more of the problems that are stated above.

SUMMARY

In an embodiment of the invention, a system includes a subsea well and a carousel of tools. The carousel of tools is adapted to automatically and selectively deploy the tools in the well to perform an intervention in the well.

In another embodiment of the invention, a method includes halting the flow of fluid in a well and deploying a tool from within the well while the fluid is halted. The tool is allowed to free fall while the fluid is halted. The flow is resumed to retrieve the tool.

In yet another embodiment of the invention, a method includes injecting sensors into a fluid of a well and using the sensors to measure a property of the well. Data is retrieved from the sensors, and this data indicates the measured properties.

Advantages and other features of the invention will become apparent from the following description, drawing and claims.

DETAILED DESCRIPTION

Figure 1:
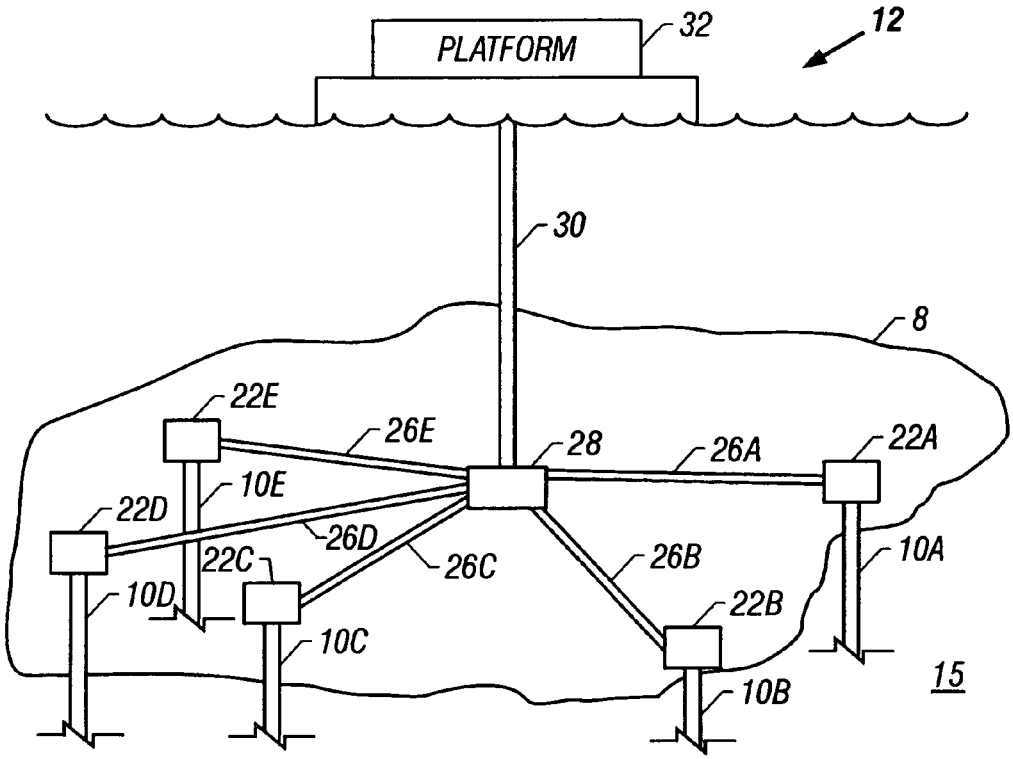
FIG. 1 is a schematic diagram of a subsea production system according to an embodiment of the invention.

Referring to FIG. 1, an embodiment of a subsea production system 12 in accordance with an embodiment of the invention includes a subsea field 8 of wells 10 (wells 10A, 10B, 10C, 10D and 10E depicted as examples). Each well 10 includes a wellbore that extends into the sea floor and may be lined with a casing or liner. Each well 10 also includes a subsea wellhead assembly 22 (wellhead assemblies 22A, 22B, 22C, 22D and 22E, depicted as examples) that is located at the well surface, which is the sea floor 15.

Each wellhead assembly 22 may be connected to a conduit 26 (e.g., hydraulic control lines, electrical control lines, production pipes, etc.) that runs to a subsea manifold assembly 28. Conduits 26A, 26B, 26C, 26D, and 26E connect respective wellhead assemblies 22A, 22B, 22C, 22D and 22E to the manifold 28. In turn, various conduits 30 are run to a host platform 32 (which can be located at the sea surface, or alternatively, on land). The platform 32 collects production fluids and sends appropriate control (electrical or hydraulic) signals or actuating pressures to the wells 10A-10E to perform various operations and may also communicate chemicals to chemical injection ports of the wellhead assemblies 22. During normal operation, well fluids are delivered through the production tubing of each well and through the conduits 26, manifold 28, and conduits 30 to the platform 32.

In some embodiments of the invention, the wellhead assembly 22 may include at least part of a system to perform light intervention, an intervention that includes self diagnosis of the associated well 10 and/or to remedy a diagnosed problem in the well. For example, as described below in some embodiments of the invention, the system that is described herein may test the well 10 at various depths, for example, to determine a composition of the well fluids that are being produced by the well. The results of this test may indicate, for example, that a particular zone of the well 10 should be plugged off to prevent production of an undesirable fluid. Thus, in this manner, the system may plug off the affected zone of the well. The testing of well fluid composition and the above-described setting of the plug intervention are just a few examples of the activities that may be performed inside the well 10 without requiring intervention that is initiated outside of the well 10, as described below.

Figure 2:
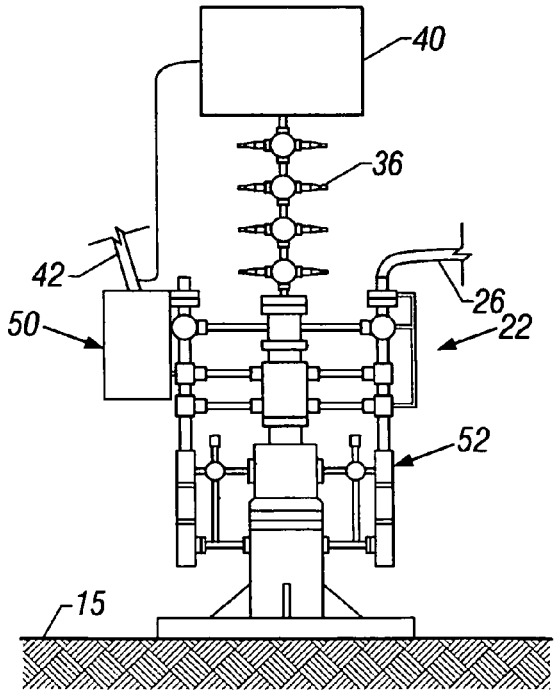
FIG. 2 is a schematic diagram of a wellhead assembly according to an embodiment of the invention.

Referring to FIG. 2, in some embodiments of the invention, each wellhead assembly 22 may include a wellhead tree 52 that controls the flow of well fluids out of the well 10 and a blowout preventer (BOP) 36 that is connected to the wellhead tree 52 for maintaining a seal in the well 10 when tools are introduced into and retrieved from the well 10. The wellhead assembly 22 also includes electronics 50 to, as described below, generally control the interventions inside the well 10. In this manner, the electronics 50 may, for example, cause (as described below) a tool to be run downhole to perform a diagnosis of the well 10 for any potential problems. Based on the results of this diagnosis, the electronics 50 may then cause (as described below) another tool to be run downhole to take corrective action, or remedy the problem.

Figure 3:
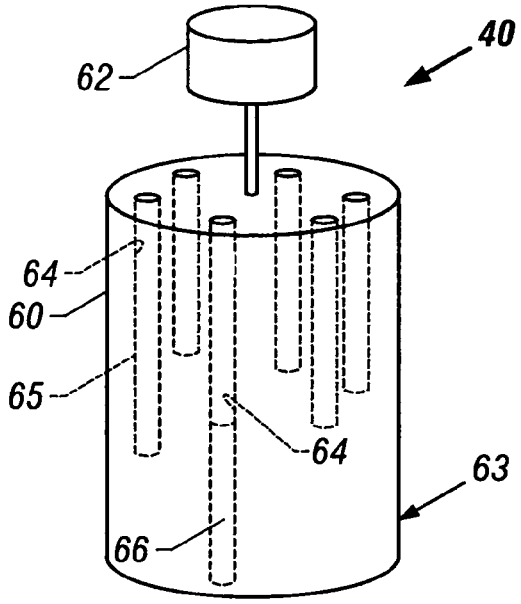
FIG. 3 is a schematic diagram of a tool carousel assembly according to an embodiment of the invention.

Referring also to FIG. 3, for purposes of making those tools available, the wellhead assembly 22 may include a tool carousel assembly 40 that is connected to the BOP 36, for example. The carousel assembly 40 includes a carousel 63 that holds various tools 65, such as tools to diagnosis the well 10 and tools to remedy problems in the well 10. In this manner, the assembly 40 includes a motor 62 that rotates the carousel 63 to selectively align tubes 64 of the carousel 40 with a tubing 66 that is aligned with the BOP 36. Each of the tubes 64 may be associated with a particular tool (also called a "dart"), such as a plug setting tool, a pressure and temperature sensing tool, etc. Thus, because the carousel assembly 40 is sealed into the well head assembly 22, self diagnosis and light intervention may be performed within the well 10 without requiring intervention that is initiated outside of the well 10.

In some embodiments of the invention, the electronics 50, well tree 52 and tool carousel assembly 40 may perform a technique 70 to run a tool downhole to perform either tests on the well 10 or some form of corrective action. The initiation of the technique may be triggered, for example, by a periodic timer, by a command sent from the sea surface, or by a previous measurement that indicates intervention is needed.

In the technique 70, the electronics 50 first stops (block 72) flow of well fluid from the well 10 by, for example, interacting with the well tree 52 to shut off the flow of fluids from the well 10. Next, the electronics 50 selects (block 74) the appropriate tool 65 from the carousel assembly 40. For example, this may include interacting with the motor 62 to rotate the carousel 63 to place the appropriate tool 65 in line with the tubing 66. Thus, when this alignment occurs, the tool 65 is deployed (block 76) downhole.

Figure 5:
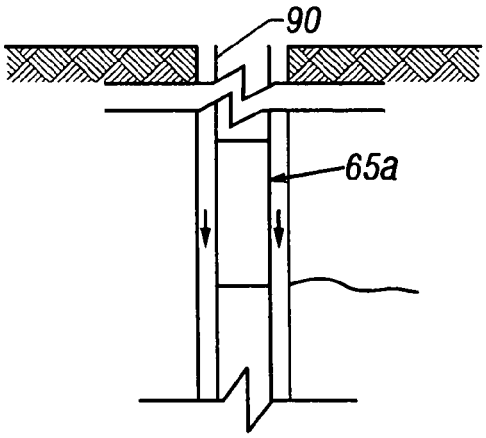
FIGS. 5, 6, 7 and 8 are schematic diagrams depicting deployment and retrieval of tools according to different embodiments of the invention.
Figure 6:
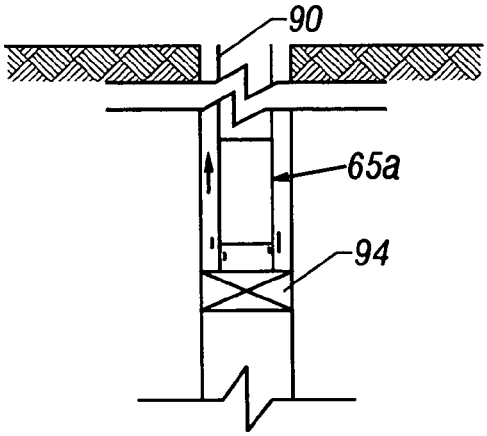

Referring also to FIGS. 5 and 6, as an example, the electronics 50 may select a tool 65*a* to set a plug 94 downhole. Thus, as depicted in FIG. 5, once deployed, the tool 65*a* descends down a production tubing 90 of the well until the tool 65*a* reaches a predetermined depth, a depth that the electronics 50 programs into the tool 65*a* prior to its release. During this descent, the electronics 50 delays for a predetermined time to allow the tool to descend to the predetermined depth and perform its function, as depicted in block 78 of FIG. 4. Therefore, for the plug setting tool 65*a*, when the tool 65*a* reaches the predetermined depth, the tool 65*a* sets the plug 94, as depicted in FIG. 6.

Figure 4:
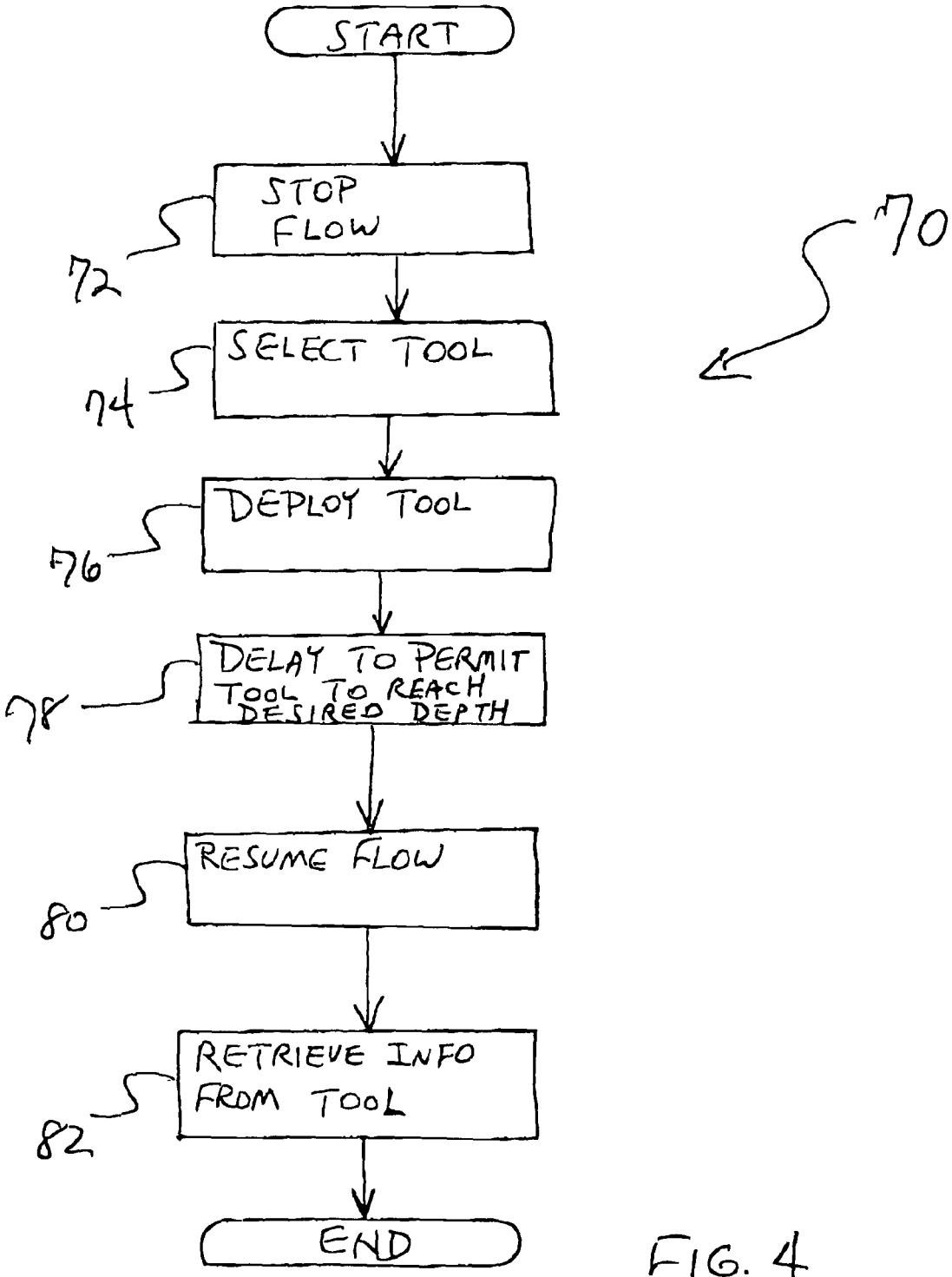
FIG. 4 is a flow diagram depicting a technique to deploy and use a tool from within the well according to an embodiment of the invention.

After the expiration of the predetermined delay, the electronics 50 interacts with the well tree 52 to resume the flow of well fluids through the production tubing 90, as depicted in block 80 of FIG. 4. Referring to both FIGS. 4 and 6, the flow of the fluids pushes the tool 65*a* back uphole. The tool 65*a* then enters the appropriate tubing 64 of the carousel 63, and the carousel 63 rotates (under control of the electronics 50). The electronics 50 may then interact with the tool 65*a* to retrieve (block 82 of FIG. 4) information from the tool 65*a*, such as information that indicates whether the tool 65 successfully set the plug 94, for example.

Figure 7:
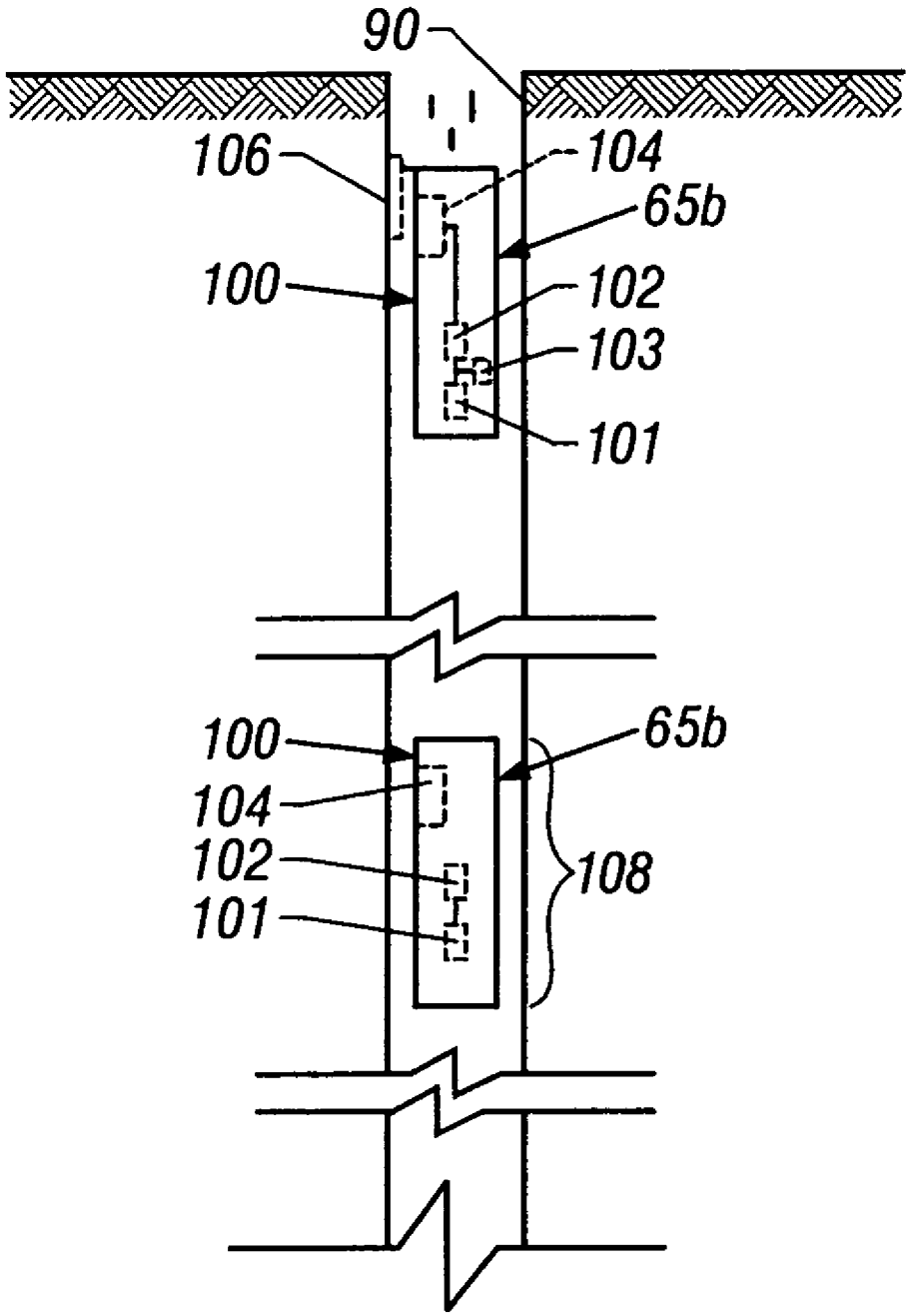

Besides indicating whether a run was successful, the tool 65 may be dropped downhole to test conditions downhole and provide information about these conditions when the tool returns to the carousel. For example, FIG. 7 depicts a tool 65*b* that may be deployed downhole to measure downhole conditions at one or more predetermined depths, such as a composition of well fluid, a pressure and a temperature. The tool 65*b* includes a pressure sensor to 103 to measure the pressure that is exerted by well fluid as the tool 65*bs* descends downhole. In this manner, from the pressure reading, electronics 102 (a microcontroller, an analog-to-digital converter (ADC) and a memory, for example) of the tool 65*b* determines the depth of the tool 65*b*. At a predetermined depth, the electronics 102 obtains a measurement from one or more sensors 103 (one sensor 103 being depicted in FIG. 7) of the tool 65*b*. As examples, the sensor 103 may sense the composition of the well fluids or sense a temperature. The results of this measurement are stored in a memory of the electronics 102. Additional measurements may be taken and stored at other predetermined depths. Thus, when the tool 65*b* is at a position 108*a*, the tool 65*b* takes one or more measurements and may take other measurements at other depths.

Eventually, the electronics 50 (see FIG. 2) interacts with the well tree 52 to reestablish a flow to cause the tool 65*b* to flow uphole until reaching the position indicated by reference numeral 108*b* in FIG. 7. As the tool 65*b* travels past the position 108*b*, a transmitter 104 of the tool 65*b* passes a receiver 106 that is located on the production tubing 90. When the transmitter 104 approaches into close proximity of the receiver 106, the transmitter 104 communicates indications of the measured data to the receiver 106. As an example, the receiver 106 may be coupled to the electronics 50 to communicate the measurements to the electronics 50. Based on these measurements, the electronics 50 may take further action, such as communicating indications of these measurements to a surface platform or sending a plug setting tool downhole to block off a particular zone, as just a few examples.

Figure 8:
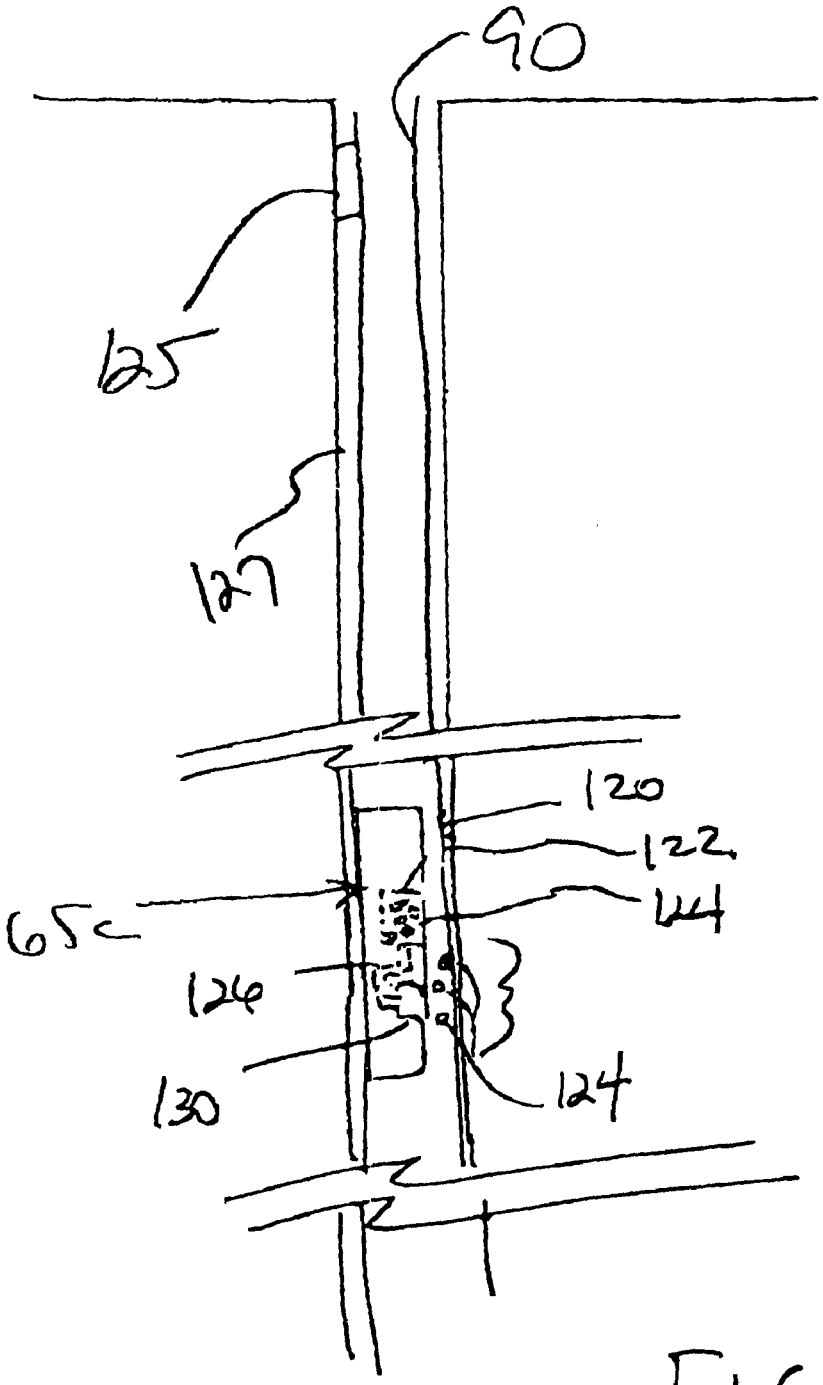

FIG. 8 depicts a tool 65*c* that represents another possible variation in that the tool 65*c* releases microchip sensors 124 to flow uphole to log temperatures and/or fluid compositions at several depths. In this manner, the tool 65*c* may travel downhole until the tool 65*c* reaches a particular depth. At this point, the tool 65*c* opens a valve 130 to release the sensors 124 into the passageway of the tubing 90. The sensors 124 may be stored in a cavity 122 of the tool 65*c* and released into the tubing 90 via the valve 130.

In some embodiments of the invention, the chamber 122 is pressurized at atmospheric pressure. In this manner, as each sensor 124 is released, the sensor 124 detects the change in pressure between the atmospheric pressure of the chamber 122 and the pressure at the tool 65*c* where the sensor 124 is released. This detected pressure change activates the sensor 124, and the sensor 124 may then measure some property immediately or thereafter when the sensor 124 reaches a predetermined depth, such as a depth indicated by reference number 127. As the sensors 124 rise upwardly reach the sea floor 15, the sensors 124 pass a receiver 125. In this manner, transmitters of the sensors 124 communicate the measured properties to the receiver 125 as the sensors 124 pass by the receiver 125. The electronics 50 may then take the appropriate actions based on the measurements. Alternatively, the sensors 124 may flow through the conduits 26 to the platform 32 (see FIG. 1) where the sensors 124 may be collected and inserted into equipment to read the measurements that are taken by the sensors.

In some embodiments, the sensors 124 may not be released by a tool. Instead, the sensors 124 may be introduced via a chemical injection line (for example) that extends to the surface platform. Once injected into the well, the sensors 124 return via the production line flowpath to the platform wherein the sensors 124 may be gathered and the measurement data may be extracted. Other variations are possible.

Figure 9:
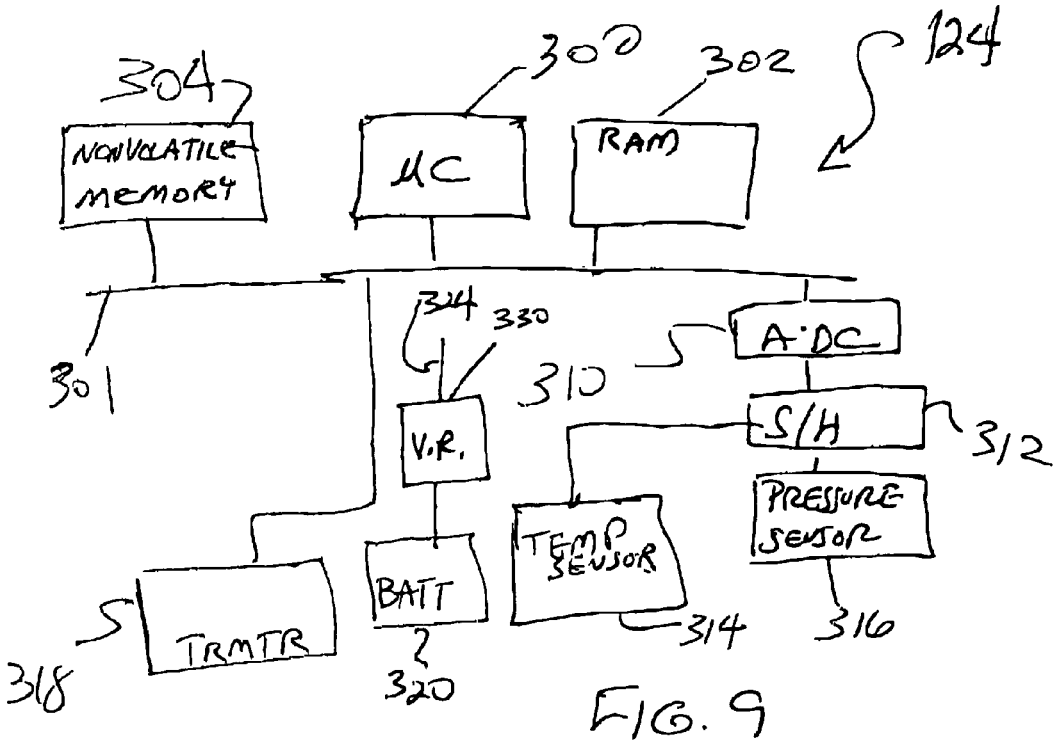
FIG. 9 is an electrical schematic diagram of a free flowing sensor according to an embodiment of the invention.

FIG. 9 depicts one of many possible embodiments of the sensor 124. The sensor 124 may include a microcontroller 300 that is coupled to a bus 301, along with a random access memory (RAM) 302 and a nonvolatile memory (a read only memory) 304. As an example, the RAM 302 may store data that indicates the measured properties, and the nonvolatile memory 304 may store a copy of a program that the microcontroller 300 executes to cause the sensor 124 to perform the functions that are described herein. The RAM 302, nonvolatile memory 304 and microcontroller 300 may be fabricated on the same semiconductor die, in some embodiments of the invention.

The sensor 124 also may also include a pressure sensor 316 and a temperature sensor 314, both of which are coupled to sample and hold (S/H) circuitry 312 that, in turn, is coupled to an analog-to-digital converter 310 (ADC) that is coupled to the bus 301. The sensor 124 may also include a transmitter 318 that is coupled to the bus 301 to transmit indications of the measured data to a receiver. Furthermore, the sensor 124 may include a battery 320 that is coupled to a voltage regulator 330 that is coupled to voltage supply lines 314 to provide power to the components of the sensor 124.

In some embodiments of the invention, the components of the sensor 124 may contain surface mount components that are mounted to a printed circuit board. The populated circuit board may be encapsulated via an encapsulant (an epoxy encapsulant, for example) that has properties to withstand the pressures and temperatures that are encountered downhole. In some embodiments of the invention, the pressure sensor 316 is not covered with a sufficiently resilient encapsulant to permit the sensor 316 to sense the pressure. In some embodiments of the invention, the sensor 316 may reside on the outside surface of the encapsulant for the other components of the sensor 124. Other variations are possible.

Figure 13:
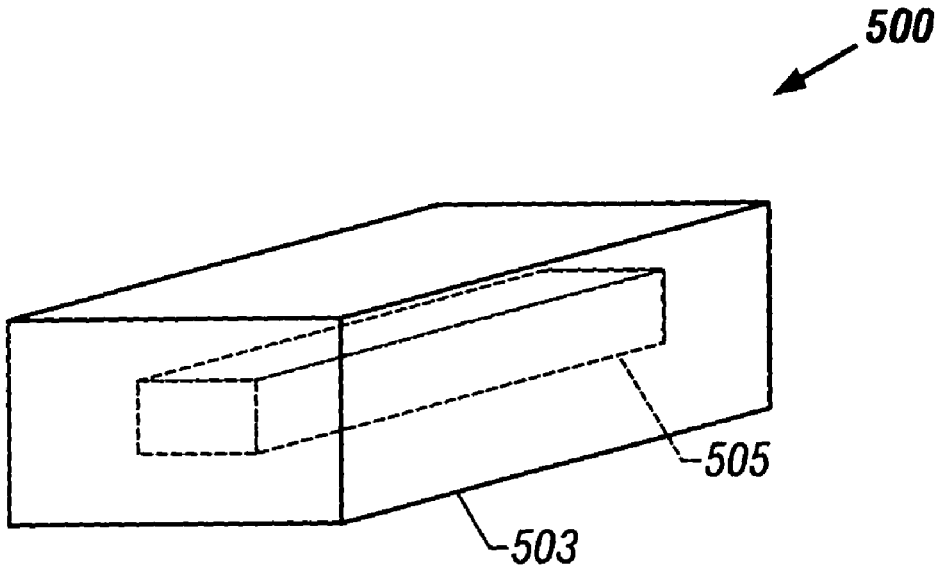
FIGS. 13 and 14 are schematic diagrams of sensors according to different embodiments of the invention.

In other embodiments of the invention, the sensor may not contain any circuitry but may change in response to a detected pressure or temperature. For example, FIG. 13 depicts a sensor 500 that may be formed from an encapsulant 503 that has a cavity 505 formed therein. In response to the pressure exceeding some predetermined threshold, the encapsulant 503 "pops" or collapses inwardly into the cavity 505, thereby indicating the predetermined threshold was exceeded. The pressure threshold sensed by the sensor 500 may be controlled by varying the thickness of the encapsulant 503, size of the cavity 505, composition of the encapsulant 503, gas content inside the cavity 505, etc.

Figure 14:
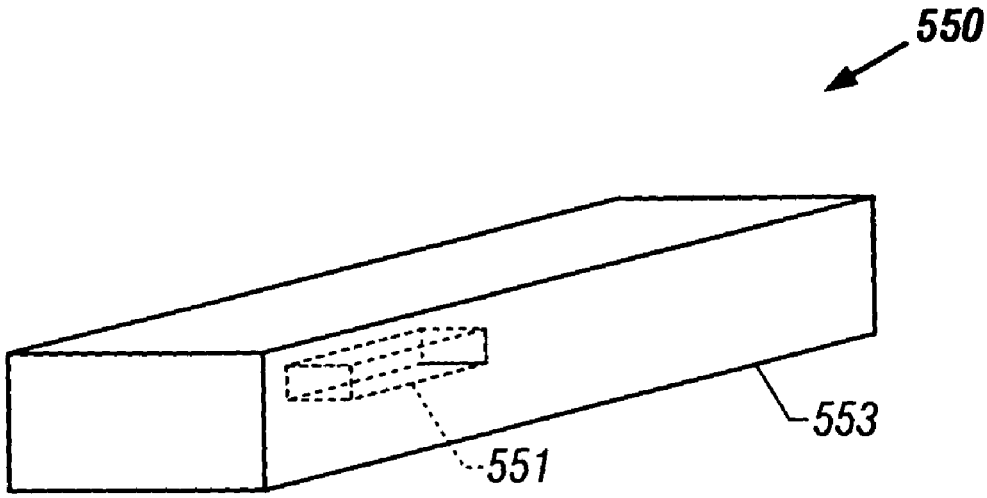

Another embodiment for a sensor 550 is depicted in FIG. 14. The sensor 550 may be used to detect a predetermined temperature. The sensor 550 may be formed from an encapsulant 553 that has a metal 551, for example, contained therein. In response to the temperature of the sensor 550 exceeding some predetermined threshold, the metal 551 melts, thereby indicating the predetermined threshold was exceeded. The temperature sensed by the sensor 550 may be controlled by varying the thickness of the encapsulant 503, composition of the metal 551, composition of the encapsulant 553, use of substitute materials for the metal 551, etc.

Other variations for the sensor are possible.

Figure 10:
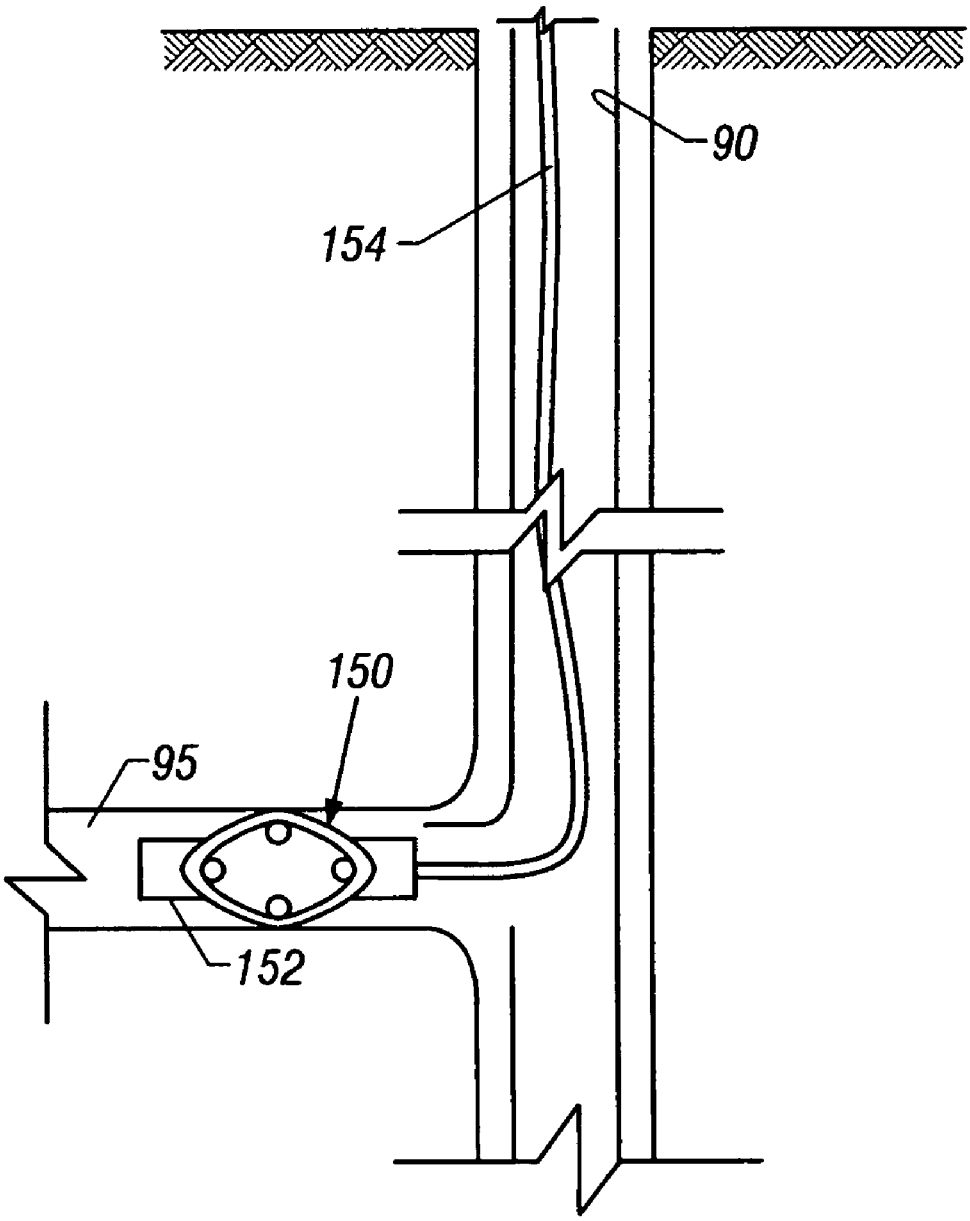
FIG. 10 is a schematic diagram of a system that includes a tractor deployed permanently inside a well according to an embodiment of the invention.

In some embodiments of the invention, an arrangement that is depicted FIG. 10 may be used inside the subsea well 10. In this manner, a robot, such as a tractor 150, may be located inside the production tubing of the well 10 to carry tools (such as a tool 152) about the well for purposes of diagnosing problems in the well and performing intervention in the well. The tractor 150 is permanently sealed inside the well 10.

The tractor 150 may be tethered from a cable 154 that is in communication with the electronics 50 and/or an operator at the platform. The tool 152 that is moved by the tractor 150 may be a tool that is designated for use by the tractor 150 or a tool that is selected from the carousel assembly 40, as just a few examples. As depicted in FIG. 10, the tractor 150 may be used to carry the tool 152 into a horizontal 95 tubing that lines a lateral well bore, for example.

Figure 11:
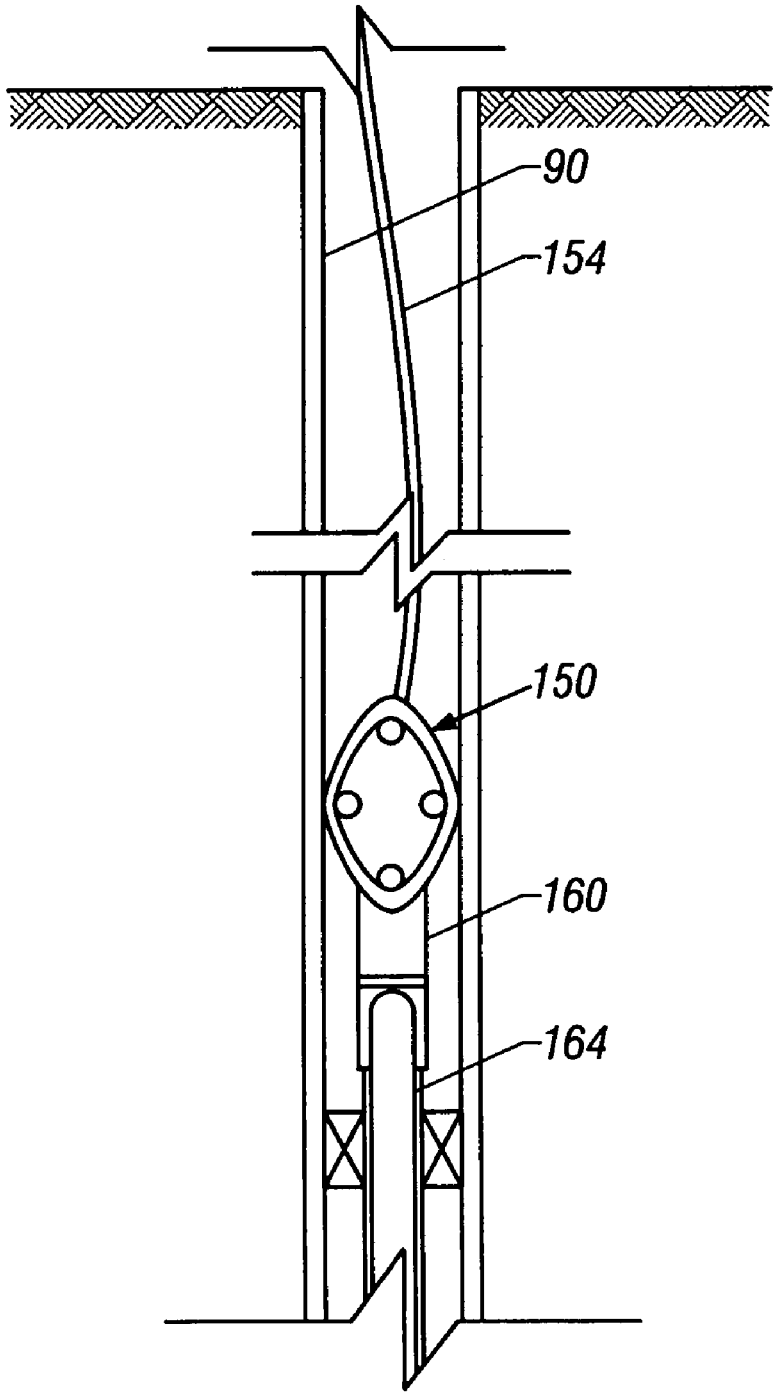
FIG. 11 is a schematic diagram depicting use of the tractor according to an embodiment of the invention.

Referring to FIG. 11, besides carrying a tool to a specific location, the tractor 150 may also be used to perform other tasks within the well 10. For example, the tractor 150 may include a robotic arm 160 that the tractor 150 may use to move the sleeve on a valve 164, for example. The tractor 150 may be used for other purposes.

Other variations are possible. For example, the tractor 150, in some embodiments of the invention, is self-guided and self-powered by its own battery. In this manner, the tractor 150 may receive commands and power to recharge its battery when stationed at a docking station in the well. The tractor 150 may be dispatched to perform a particular task from the docking station without being connected to the docking station. After performing the function, the tractor 150 returns to the docking station.

Figure 12:
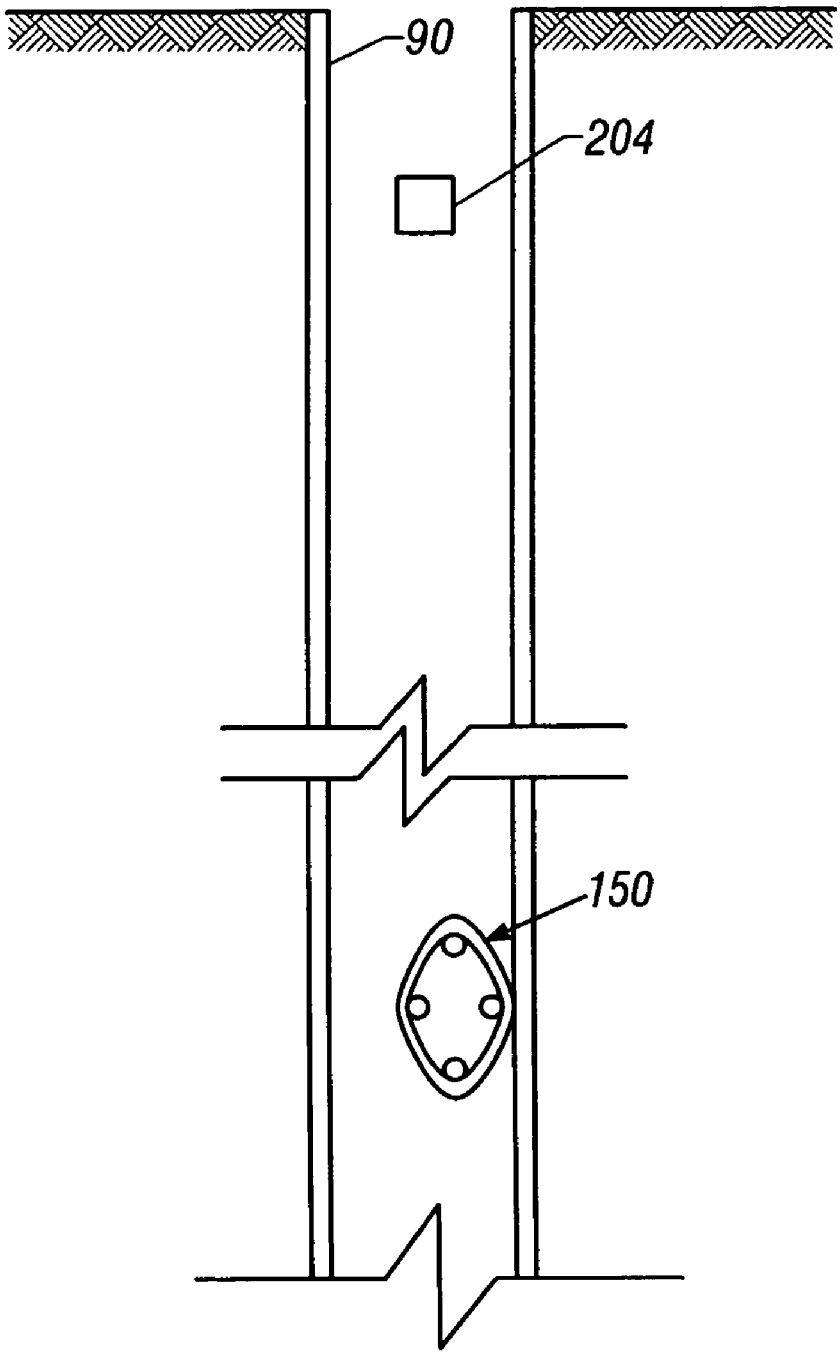
FIG. 12 is a schematic diagram of a well depicting the tractor in a collapsed state and the release of a buoyant member to indicate the collapsed state according to an embodiment of the invention.

It is possible that the tractor 150 may become lodged inside the production tubing during the performance of a given task. Should the tractor 150 become lodged to the point that it is not possible or feasible to dislodge the tractor 150, the tractor 150 may collapse, as depicted in FIG. 12 and fall to the bottom of the well bore. For the case where the tractor 150 becomes lodged and does not have a tethered cable connection, the tractor 150 may communicate by releasing a buoyant member 204 that propagates through the production tubing to the platform to indicate that the tractor 150 has become lodged and has assumed the collapsed position.

While the invention has been disclosed with respect to a limited number of embodiments, those skilled in the art will appreciate numerous modifications and variations therefrom. It is intended that the appended claims cover all such modifications and variations as fall within the true spirit and scope of the invention.

What is claimed is:

1. A method comprising:

halting the flow of a well fluid being produced from a well;

deploying a tool from within the well while the flow is halted;

allowing the tool to free fall in the well while the flow is halted;

measuring the pressure of the well around the tool as the tool free falls;

determining the depth of the tool based on the measured well pressure;

comparing the tool depth to a predetermined well depth;

measuring a property of the well at the predetermined tool depth; and resuming the flow to retrieve the tool.

2. The method of claim 1, further comprising:

introducing a delay to allow the tool to reach a given depth.

3. The method of claim 1, further comprising:

using the tool to perform a test in the well.

4. The method of claim 1, further comprising:

using the tool to take a corrective action in the well.

5. The method of claim 1, further comprising:

triggering the halting in response to a periodic timer.

6. The method of claim 1, further comprising:

triggering the halting in response to a command.

7. The method of claim 1, further comprising:

triggering the halting in response to a previous measurement indicating intervention is needed in the well.

8. The method of claim 1, wherein the flow of fluid comprises well fluid being produced by the well.

9. A method comprising:

halting the flow of a well fluid being produced from a well;

deploying a tool from within the well while the flow is halted;

allowing the tool to free fall in the well while the flow is halted;

measuring the pressure of the well around the tool as the tool free falls;

determining the depth of the tool based on the measured well pressure;

comparing the tool depth to a predetermined well depth;

using the tool to measure a property of the well at the predetermined depth;

measuring a second pressure of the well around the tool as the tool continues to free fall;

determining the depth of the tool based on the second measured well pressure;

comparing the tool depth to a second predetermined well depth;

using the tool to measure a second property of the well at the second predetermined depth; and resuming the flow to retrieve the tool.

10. The method of claim 9, further comprising:

introducing a delay to allow the tool to reach a given depth.

11. The method of claim 9, further comprising:

using the tool to perform a test in the well.

12. The method of claim 9, further comprising:

using the tool to take a corrective action in the well.

13. The method of claim 9, further comprising:

triggering the halting in response to a periodic timer.

14. The method of claim 9, further comprising:

triggering the halting in response to a command.

15. The method of claim 9, further comprising:

triggering the halting in response to a previous measurement indicating intervention is needed in the well.

16. The method of claim 9, wherein the flow of fluid comprises well fluid being produced by the well.

* * * * *